US008616551B2

(12) United States Patent
Swalley

(10) Patent No.: US 8,616,551 B2
(45) Date of Patent: Dec. 31, 2013

(54) TABLETOP SPORTS

(76) Inventor: Michael R. Swalley, Brownsburg, IN (US)

( * ) Notice: Subject to any disclaimer, the term of this patent is extended or adjusted under 35 U.S.C. 154(b) by 289 days.

(21) Appl. No.: 13/197,579

(22) Filed: Aug. 3, 2011

(65) Prior Publication Data

US 2012/0032392 A1 Feb. 9, 2012

Related U.S. Application Data

(60) Provisional application No. 61/370,141, filed on Aug. 3, 2010.

(51) Int. Cl.

| | |
|---|---|
| ***A63F 7/00*** | (2006.01) |
| ***A63B 71/04*** | (2006.01) |
| ***A63F 7/07*** | (2006.01) |

(52) U.S. Cl.

USPC ..... 273/108.1; 273/110; 273/118 R; 273/123 R; 273/441

(58) Field of Classification Search

USPC ..... 273/108, 109–117, 449, 451, 108.1

See application file for complete search history.

(56) References Cited

U.S. PATENT DOCUMENTS

| | | | | | |
|---|---|---|---|---|---|
| 1,201,974 | A | * | 10/1916 | Kohler | 273/110 |
| 1,215,033 | A | * | 2/1917 | King | 273/110 |
| 1,502,365 | A | * | 7/1924 | Wilson | 273/110 |
| 2,152,872 | A | * | 4/1939 | Cheatham, Jr. | 273/110 |
| 2,562,126 | A | * | 7/1951 | Rishel | 273/110 |
| 2,563,334 | A | * | 8/1951 | Hotte | 273/110 |
| 3,554,553 | A | * | 1/1971 | Hayashi | 273/110 |
| 3,643,952 | A | * | 2/1972 | Sprowl | 273/110 |
| 3,815,917 | A | * | 6/1974 | Brown | 273/110 |
| 3,931,972 | A | * | 1/1976 | Fabian | 273/110 |
| 4,089,526 | A | * | 5/1978 | Olving | 273/110 |
| 4,094,507 | A | * | 6/1978 | Kauffmann | 273/110 |
| 4,216,963 | A | * | 8/1980 | Boucher | 273/110 |
| 4,310,159 | A | * | 1/1982 | Wing | 273/108 |
| 4,448,416 | A | * | 5/1984 | Belter | 273/110 |
| 4,589,664 | A | * | 5/1986 | Slimp, Jr. | 273/258 |

* cited by examiner

*Primary Examiner* — Sebastiano Passaniti
(74) *Attorney, Agent, or Firm* — Sinorica, LLC

(57) ABSTRACT

The present invention implements the use of tension in interacting cables to maintain control of a table-top. By creating an apparatus designed to replicate an actual sports field, the table-top sports game allows for indoor playing of a popular sport. Also, since the game makes use of hand-eye coordination rather than placing an emphasis on foot-eye coordination, it allows various people, especially those with lower appendage disabilities, to enjoy the sport as well.

12 Claims, 7 Drawing Sheets

TABLETOP SPORTS

The current application claims a priority to the U.S. Provisional Patent application Ser. No. 61/370,141 filed on Aug. 3, 2011.

FIELD OF THE INVENTION

The present invention relates generally to indoor game equipment. The objective of the present invention is to bring outdoor sports, such as football, soccer or racing, inside. The present invention makes use of a miniature version of most outdoor organized games.

BACKGROUND OF THE INVENTION

Many organized sports are traditionally played outdoors. However, with that comes the problem of dealing with the weather, which often can put a stop to a game being played outdoors. Also, since most sports rely on efficient mobility and dexterity, people who have lower appendage disabilities are not able to play. Table-top sports not only creates a way to play these sports inside, but also enables everyone to participate, handicapped or not.

DETAIL DESCRIPTIONS OF THE INVENTION

Figure 1:
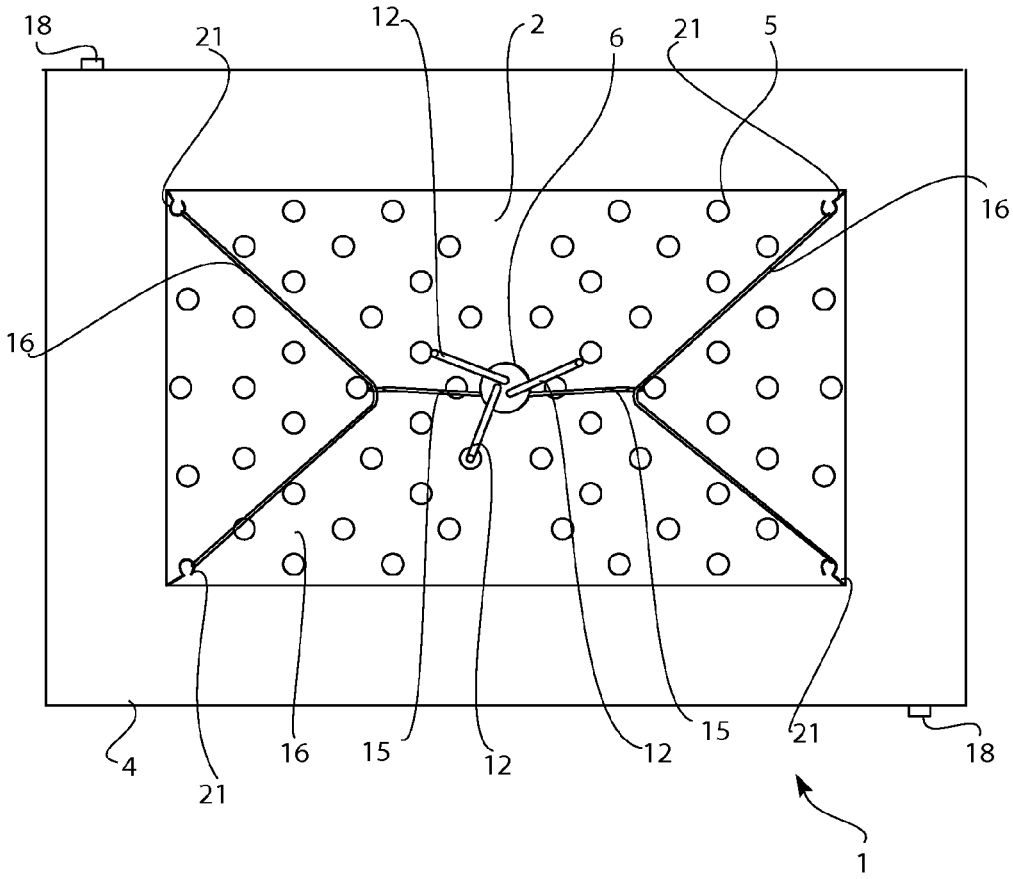
FIG. 1 is a bottom plan view of the present invention.
Figure 2:
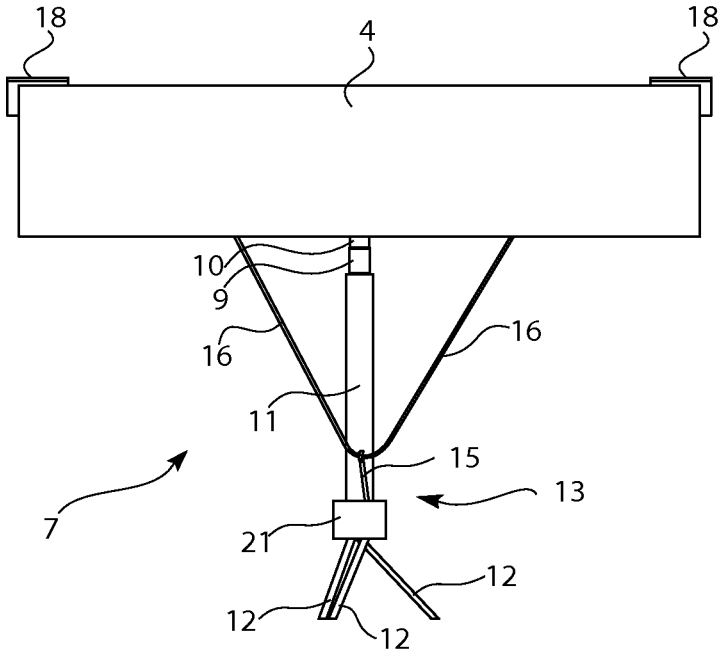
FIG. 2 is a right side view of the present invention.
Figure 3:
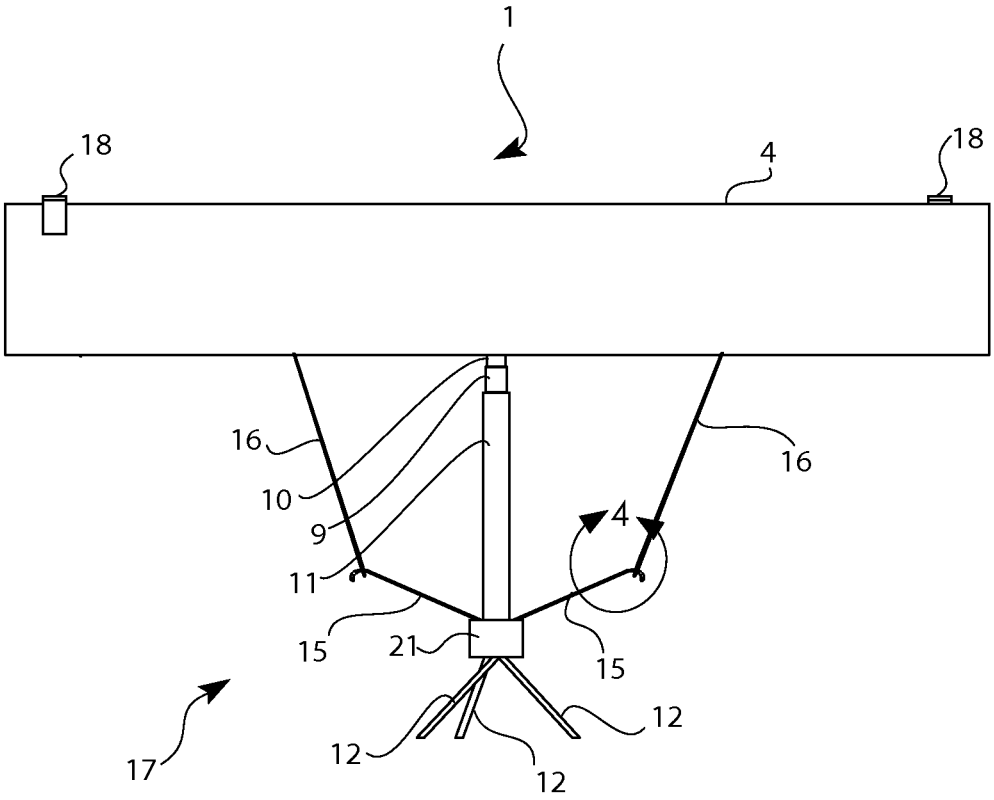
FIG. 3 is a front plan view of the present invention in which a detailed view is taken and shown in FIG. 4.
Figure 4:
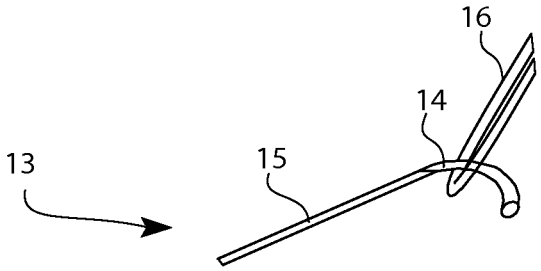
FIG. 4 is a detailed view of the tension cable system. The diagram shows the components and mechanisms involved with tension cable system.

All illustrations of the drawings are for the purpose of describing selected versions of the present invention and are not intended to limit the scope of the present invention.

Table-top sports are indoor replicas of typical outdoor sports fields. While using the same concepts and rules as traditional sports games, table-top sports are able to bring the pleasure of playing sports games from outside to the indoors. Table-top sports use a mechanism of tilt in relation to gravity to move the ball from one position to another. This not only creates a more challenging game, but also helps to develop hand-eye coordination skills. Table-top sports essentially only comprises of three interacting components, a game table, a mount, and a score keeper. All three components work together to simulate a real game. The skill in this game comes into play when attempting to control the ball with only the tilt of the table and gravity.

In references to FIG. 1, FIG. 2, FIG. 3, FIG. 5, FIG. 6, FIG. 7, and FIG. 9, the table-top sports game comprises of a game table 1, a mount 7, a plurality of defenders 21, and a plurality of score keepers 17. The game table 1 is a table that will be tilted to move the ball. The mount 7 is the apparatus that keeps the game table 1 upright and helps to control the movement of the game table 1. The defenders 21 help to act as defense players when playing organized sports, such as football. The score keeper 17 tracks scores while playing the table-top sports game. Combining these various elements together creates a traditional sports environment.

Figure 5:
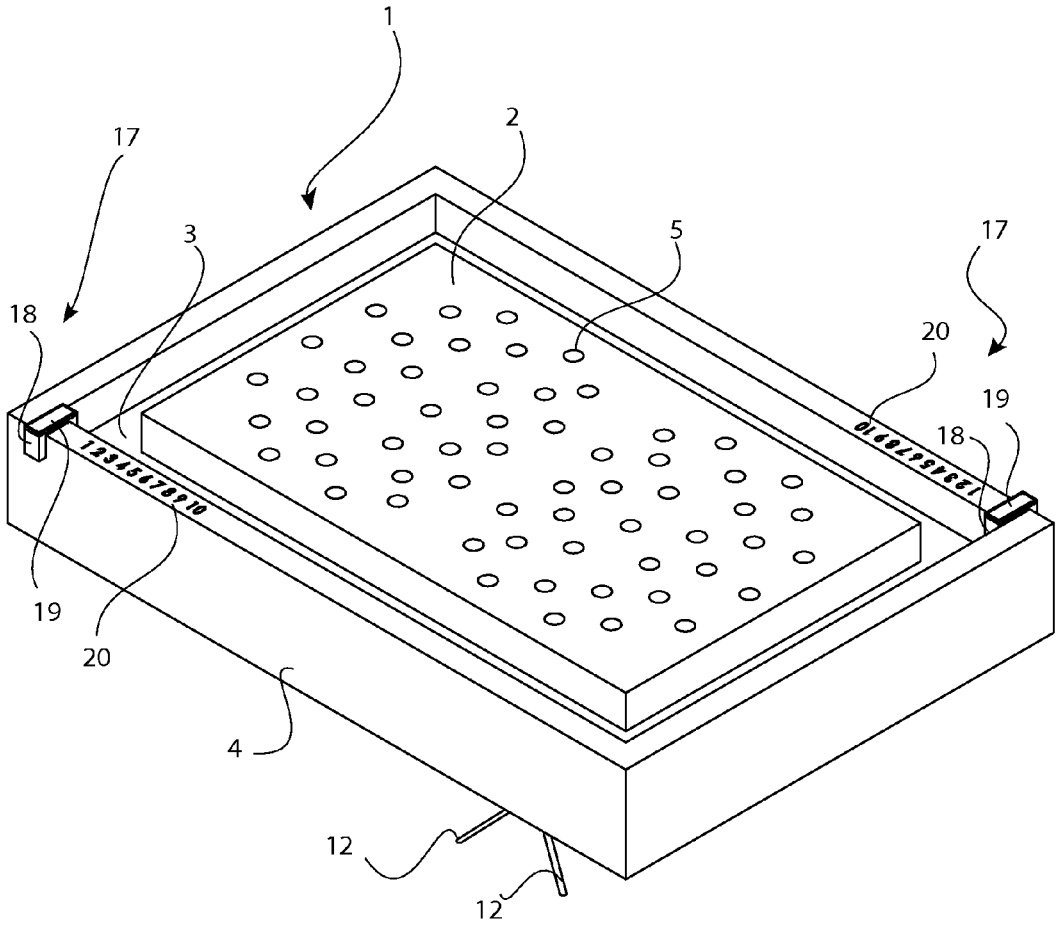
FIG. 5 is a perspective view of the present invention.
Figure 6:
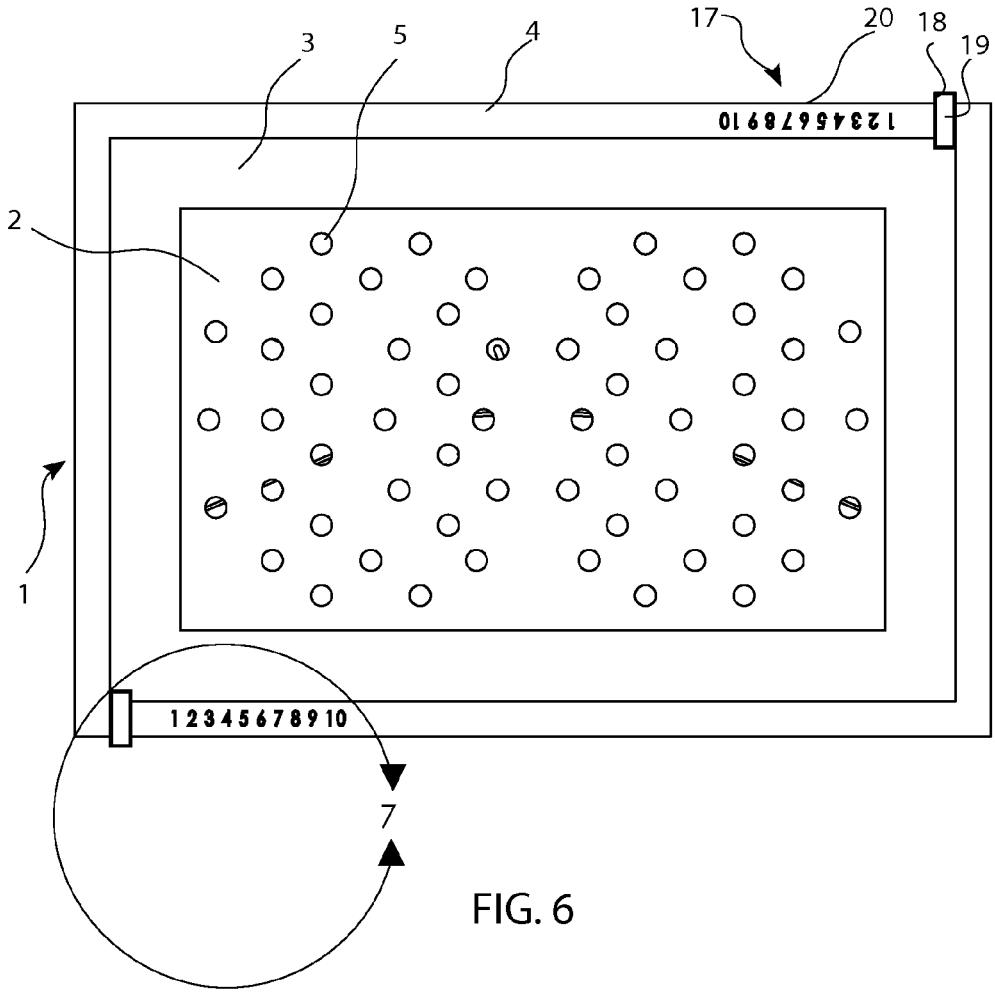
FIG. 6 is a top plan view of the present invention upon which a detail view is taken and shown in FIG. 7

In references to FIG. 1, FIG. 5, and FIG. 6, a major component of the table-top sports is the game table 1. The component comprises of a field table 2, a plurality of side gutters 3, a plurality of table walls 4, a plurality of holes 5, a pivot 6, and a plurality of cable hooks 21. To be able to play outdoor sports on a table top, the surface on which the game is played must mimic an actual outdoor sports field. To do so, the field table 2 is designed just as a real outdoor sports field would be. There are designated regions that represent center field, goal lines, and sidelines. This enables players to play table-top sports with the same rules as traditional sports games. Tilting the game table 1 from left to right can eventually cause the ball to fall off of the game table. To prevent this from happening, the game table 1 implements the use of the plurality of side gutters 3 and the plurality of table walls 4. The plurality of side gutters 3 are recessed regions of the game table 1 that separate the field table 2 from the plurality table walls 4. Lining the perimeter of the field table 2, the side gutters 3 trap the ball in case it rolls off the field table 2. Also, the plurality of side gutters 3 help to simulate an environment of playing a real game because they help to identify out-of-bounds areas, similar to an ordinary sports field. It is important to maintain a similar field setup to traditional sports field because the similarities create a better playing environment. To further prevent the loss of the ball, the plurality of table walls 4 were implemented as guard walls around the perimeter of the plurality of side gutters 3. The table walls 4 help to trap the ball when it falls into the gutters 3. Also, the table walls 4 provide surfaces which the players can grip when the game table 1 needs to be tilted. Since the table walls 4 are along the entire perimeter of the game table 1, there is an abundance of surfaces that the players can have immediate access to incase a quick game decision needs to be made (i.e., when the game table 1 must be tilted) The holes 5, help to maintain an environment of playing an organized sport, such as football, because they serve as markers that help maintain the rules of the game. For instance, if one were to play football on the game table 1, the holes would represent field goals, touchdowns, and downs, depending on the location of the hole (at either end of the field table 2, or in the middle of the field table 2). If the ball were to fall into any of the holes 5, along the field table 2, it would then be claimed as a down. Essentially, each player has four downs (or tries) to move the ball to one of the holes 5 that represent the field goals and touchdowns behind the marked goal line. The actual movement of the game table 1 revolves around the interaction of the pivot 6 and the mount 7. The pivot 6, located on the field table's 2 bottom surface, ensures that the entire game table 1 could move in any direction. It is a rounded impression on the field table's 2 bottom surface that comes into contact with the mount 7 which is also rounded at its tip. The contact between the two surfaces creates a joint that has a wide range of movement because it is not fixed. The ability to pivot and position the game table 1 is important because allowing the game table 1 to move in different directions means that players have the same freedom of movement and options as real players on a real sports field. Again, it also helps to mimic the environment of a real sports game. Another important component that aids in creating a game as closely related to outdoor sports as possible is the mount 7. The cable hooks 21 are attached on underside of the table walls 4. The cable hooks 21 are another area in which the mount 7 comes into contact with the game table 1.

Figure 9:
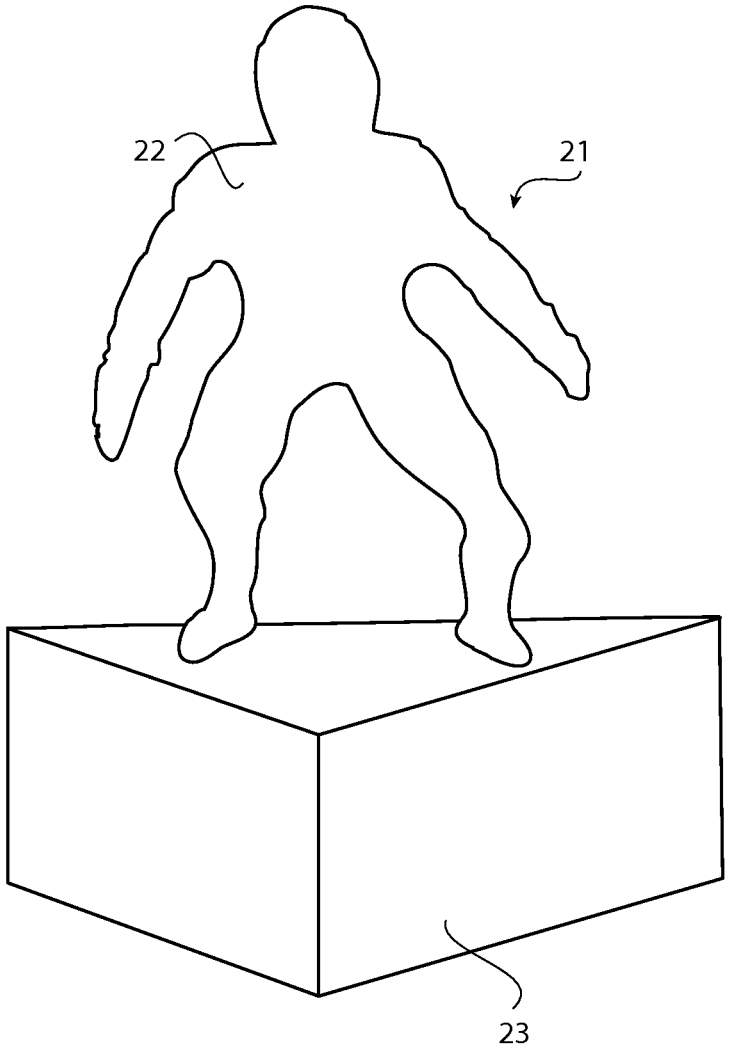
FIG. 9 is a frontal view of the defender.

Referring to FIG. 9, a component that is used in conjunction with the game table 1 is the plurality of defenders 21. Each of the defenders 21 is comprised of a defender body 22 and a defender stand 23. The defender stand 23 is placed atop the field table 2. The desired material for the defender stand 23 would be soft yet durable so as not to damage the field table's 2 surface whilst playing a game. The game piece is essentially used for its namesake. It requires that multiple pieces, the number varying depending on which game is being played, be placed on the field table 2. These defenders 21 behave as real defensive players would, to attempt to stop the ball from travelling to the defender's 21 holes 5 that are for goals.

In references to FIG. 1, FIG. 2, FIG. 3, FIG. 4, the next major component of the table-top sports game is the mount 7. The mount 7, which can be made of a variety of materials such as plastic or wood, is used mainly to help maintain the height and balance of the game table 1. Tilting the game table 1 must be done manually, so as to maintain control over the game. Therefore, it is important to keep the game table 1 upright, when it is not being intentionally moved. As a result, the ball can rest without the force of gravity causing it to roll to an unwanted position. It also helps to control the movement of the game table 1. This is done through the interaction of the other components of the mount. The mount comprises of a center post 8, a plurality of support legs 12, a plurality of tension cables 13, and a plurality of support cables 16. The center post 8, comprised of a grip 9, an inner post 10, and an outer post 11, is located directly underneath the game table's 1 center. The pivot 6, as mentioned before, rests atop the center post 8 and under the game table's 1 center. The interaction between the two parts creates the titling motion of the game table 1. The inner post 10 is aligned atop of the outer post 11. The grip 9 connects the inner post 10 and outer post 11 to each other. One of the goals of this apparatus is to make certain that anyone can enjoy the game. The adjustable height of the product ensures that people of different heights can play as well as people with varying disabilities. Traditionally, people with lower appendage injuries or disabilities are not able to play outdoor contact sports because most sports require a form of foot-eye coordination. However, the table-top sports game is designed to be controlled with hands, not feet. As a result, anyone who is able to tilt the game table 1 will be able to play. To change the game table's 1 height, players can use the grip 9 to pull on the center post 8 to make it shorter or taller in height. Height can be changed because of the interaction between the inner post 10 and the outer post 11. When shortening the height of the center post 8, the inner post 10 begins to retreat into the outer post 11 because it is smaller in diameter. Also, the grip 9 is ergonomically shaped to sit comfortably in a player's hand. A comfortable hold on the center post 8 will make it much easier to expand or retract in height. The next part of the mount 7 is the plurality of support legs 12 that are attached at the base 21 of the center post 8. The plurality support legs 12 come into contact with the ground surface so the game table 1 is able to stay upright and balanced, especially during movement. The plurality of tension cables 13 are attached to the base 21 of the center post 8. The plurality of tension cables 13 comprise of an elastic cable 15 and a hook 14. The plurality of tension cables 13 are connected to the support cables 16. One end of the elastic cable 15 is attached to the base 21 while another end of the elastic cable 15 is the hook 14. Because of its elastic cable 15 components, the tension cables 13 can be stretched and attached to the support cables 12 with the hook 14. The support cables 12 are attached on either end to the cable hooks 21 that are located on the table walls 4. As a result, the support cables 12 hang from the field table 2. The hooks 14 on the tension cables 13 are attached on the support cables 16 and subsequently, the support cables 16 are pulled towards the center post 8. The support cables 16 and tension cables 13 remain in tension with each other. The tension between the cables creates a spring-like force that causes the game table 1 to remain in position until it is forcefully moved. Therefore, when the game table 1 is tilted, the support cables 16 and tension cables 13 can pull the game table 1 back to its original rest position unless it is held differently. This also creates a challenge in the game. The players will have to be able to compete not only against each other for control of the game table 1, but also against the tension cables 13 and the support cables 16. The tension cables 13 and the support cables 16 also help to ensure that the game table's 1 position is kept in control. The only other support the game table 1 has is the pivot 6 in its center. The pivot 6 alone is not sufficient to keep the game table 1 balanced and upright when not being forcefully tilted. The support cables 16 and tension cables 13 can stretch and un-stretch when needed, allowing for an easy adjustment to the game table's 1 position.

Figure 7:
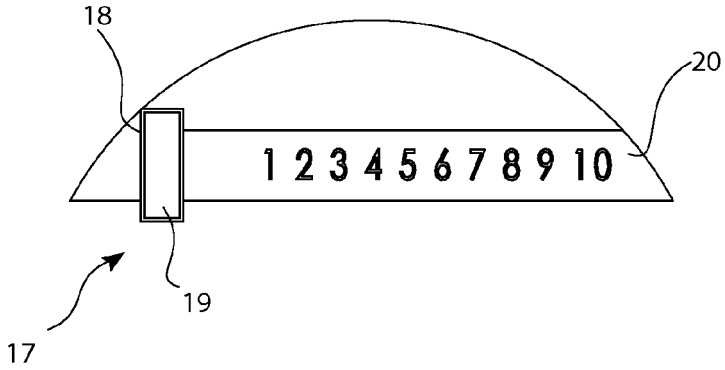
FIG. 7 is a detailed view of the score keeper system. The diagram shows the components and mechanisms involved with the score keeper system.
Figure 8:
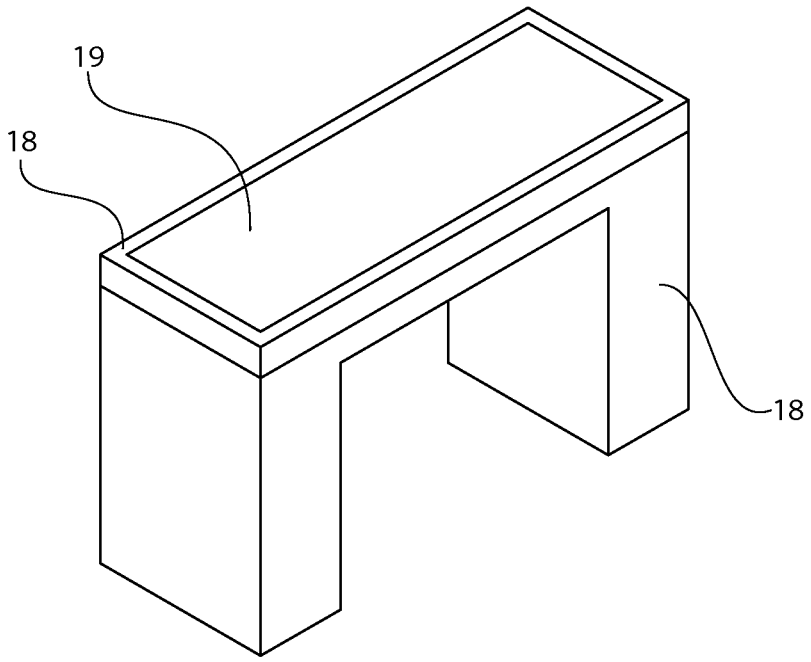
FIG. 8 is a perspective view of the bracket.

In references to FIG. 6, FIG. 7, FIG. 8, the last component of the table-top sports game is the plurality of score keepers 17. The component provides a convenience to the players of the game. The score keepers 17, consists of a numbered scale 20 and a bracket 18. The numbered scale 20 is a list of numbers that represent the amount of points available to win. The bracket 18 also has a window 19 that allows the score to be read. The purpose of the bracket 18 is so the players can slide it along the numbered scale 20 and stop where the respective score is. This keeps track of the score of that team, which is very convenient because it enables the score to be kept accurately, without the worry of having to write it down or attempt to memorize it. Also, the locations of the score keepers 17 are also very accessible, which adds to the ease of use of the score keeper 17. The score keepers 17 are located at either end of the game table 1 so each opponent has their own score tracker. The close proximity of the score keeper 17 ensures that a player will be able to quickly change the score with minima disturbance to the rest of the game. Also, since the bracket 18 can slide along the edge of the plurality of table walls 4, scores can easily be changed or adjusted, without creating a hassle for the players. The bracket 18 is only slightly larger than the plurality of table walls' 4 thickness, which means that the bracket 18 has enough room to slide easily on the plurality of table walls 4 without the danger of getting stuck if it were too snug of a fit, or the danger of falling off because it was too big for the plurality of table walls 4. This is an essential part of the design for the bracket because of how it is attached on the table walls 4. Since the game table 1 will be tilted from side to side, it is important that the bracket 18 does not move as a result of the motion of the game table 1. If the bracket 18 were to move freely, then it has the possibility of moving to the wrong score and as a result ruins the game.

The above components form and operate table-top sports. Through the interactions between the various components, the table-top sports game is able to successfully create a method for playing miniature sports.

Although the invention has been explained in relation to its preferred embodiment, it is to be understood that many other possible modifications and variations can be made without departing from the spirit and scope of the invention as hereinafter claimed.

What is claimed is:

1. A table-top sports game comprising, a game table;

a mount;
a plurality of defenders;
the game table comprising a plurality of side gutters, a field table, a pivot, a plurality of table walls, a plurality of cable hooks, and a plurality of holes;
each said defender comprising a defender body and a defender stand;
the pivot being positioned in the center of the field table;
the plurality of side gutters being positioned adjacent to the field table;
the plurality of table walls being positioned adjacent to the plurality of side gutters;
the plurality of cable hooks being attached on the plurality of table walls under the field table;
the plurality of holes being traversed through the field table;
the plurality of defenders being positioned atop the field table;
the defender body being attached to the defender stand;
the defender stand being positioned on the field table;
the numbered scale being positioned on the plurality of table walls;
the bracket comprising a window;
the bracket being positioned on the plurality of table walls beside the numbered scale; and
the window being positioned on the bracket.

2. The table-top sports game as claimed in claim 1 and further comprising,
the mount comprising a center post, a plurality of support legs, a plurality of tension cables, and a plurality of support cables.

3. The table-top sports game as claimed in claim 2 and further comprising,
the plurality of support legs being positioned at one end of the center post;
the plurality of tension cables being attached to the plurality of support legs;
the plurality of support cables being attached to the plurality of cable hooks; and
the plurality of tension cables being attached to the plurality of support cables.

4. The table-top sports game as claimed in claim 3 and further comprising,
the center post comprising a grip, an inner post, and an outer post;
the grip being positioned on the center post; and
the inner post being aligned on top of the outer post.

5. The table-top sports game as claimed in claim 3 and further comprising,
each said tension cable comprising of a hook and an elastic cable;
the hook being positioned on an end of the elastic cable; and
the hook being attached to the support cables.

6. The table-top sports game as claimed in claim 1 and further comprising,
a plurality of score keepers; and
each said score keeper comprising a numbered scale and a bracket.

7. A table-top sports game comprising,
a game table;
a mount;
a plurality of defenders;
and a plurality of score keepers;
the game table comprising a plurality of side gutters, a field table, a pivot, a plurality of table walls, a plurality of cable hooks, and a plurality of holes;
each said defender comprising a defender body and a defender stand;
each said score keeper comprising a numbered scale and a bracket;
the mount comprising a center post, a plurality of support legs, a
plurality of tension cables, and a plurality of support cables;
the pivot being positioned in the center of the field table;
the center post comprising a grip, an inner post, and an outer post;
the grip being positioned on the center post;
the inner post being aligned on top of the outer post;
the plurality of side gutters being positioned adjacent to the field table;
the plurality of table walls being positioned adjacent to the plurality of side gutters;
the plurality of cable hooks being attached on the plurality of table walls under the field table;
the plurality of holes being traversed through the field table;
the plurality of defenders being positioned atop the field table;
the defender body being attached to the defender stand;
the defender stand being positioned on the field table;
the numbered scale being positioned on the plurality of table walls;
the bracket comprising a window;
the bracket being positioned on the plurality of table walls beside the numbered scale; and
the window being positioned on the bracket.

8. The table-top sports game as claimed in claim 7 and further comprising,
the plurality of support legs being positioned at one end of the center post;
the plurality of tension cables being attached to the plurality of support legs;
the plurality of support cables being attached to the plurality of cable hooks; and
the plurality of tension cables being attached to the plurality of supporting cables.

9. The table-top sports game as claimed in claim 8 and further comprising,
each said tension cable comprising a hook and an elastic cable;
the hook being positioned on an end of the elastic cable; and
the hook being attached to the plurality of supporting cables.

10. A table-top sports game comprising,
a game table;
a mount;
a plurality of defenders;
and a plurality of score keepers;
the game table comprising a plurality of side gutters, a field table, a pivot, a plurality of table walls, a plurality of cable hooks, and a plurality of holes;
each said defender comprising a defender body and a defender stand;
each said score keeper comprising a plurality of numbered scales and a bracket;
the mount comprising a center post, a plurality of support legs, a plurality of tension cables, and a plurality of support cables;
the pivot being positioned in center of the field table;
the plurality of side gutters being positioned adjacent to the field table;

the plurality of table walls being positioned adjacent to the plurality of side gutters;

the plurality of cable hooks being attached on the plurality of table walls under the field table;

the plurality of holes being traversed through the field table;

the plurality of defenders being positioned atop the field table;

the defender body being attached to the defender stand;

the defender stand being positioned on the field table;

the numbered scale being positioned on the plurality of table walls;

the bracket comprising a window;

the bracket being positioned on the plurality of table walls beside the numbered scale;

the window being positioned on the bracket;

the plurality of support legs being positioned at one end of the center post;

the plurality of tension cables being attached to the plurality of support legs;

the plurality of support cables being attached to the plurality of cable hooks; and the plurality of tension cables being attached to the plurality of supporting cables.

11. The table-top sports game as claimed in claim 10 and further comprising, the center post comprising a grip, an inner post, and an outer post;

the grip being positioned on the center post; and the inner post being aligned on top of the outer post.

12. The table-top sports game as claimed in claim 10 and further comprising, each tension cable comprising a hook and an elastic cable;

the hook being positioned on an end of the elastic cable; and the hook being attached to the plurality of supporting cables.

* * * * *